US007754960B2

(12) United States Patent
Yamamoto et al.

(10) Patent No.: US 7,754,960 B2
(45) Date of Patent: Jul. 13, 2010

(54) ELECTRONIC EQUIPMENT SYNCHRONOUSLY CONTROLLING LIGHT EMISSION FROM LIGHT EMITTING DEVICES AND AUDIO CONTROL

(75) Inventors: Isao Yamamoto, Kyoto (JP); Koichi Miyanaga, Kyoto (JP)

(73) Assignee: Rohm Co., Ltd. (JP)

( * ) Notice: Subject to any disclaimer, the term of this patent is extended or adjusted under 35 U.S.C. 154(b) by 977 days.

(21) Appl. No.: 11/092,642

(22) Filed: Mar. 29, 2005

(65) Prior Publication Data

US 2005/0217457 A1 Oct. 6, 2005

(30) Foreign Application Priority Data

Mar. 30, 2004 (JP) ..... 2004-098907
Mar. 2, 2005 (JP) ..... 2005-057608

(51) Int. Cl.
*G10H 7/00* (2006.01)
*G10H 1/00* (2006.01)
*A63J 17/00* (2006.01)
*A63J 5/10* (2006.01)

(52) U.S. Cl. ..... 84/645; 84/464 R

(58) Field of Classification Search ..... 84/464 R, 84/464 A, 645

See application file for complete search history.

(56) References Cited

U.S. PATENT DOCUMENTS 5,402,702 A * 4/1995 Hata ..... 84/464 R
5,461,188 A * 10/1995 Drago et al. ..... 84/600
5,689,078 A * 11/1997 McClard ..... 84/600
5,769,527 A * 6/1998 Taylor et al. ..... 362/85
5,986,201 A * 11/1999 Starr et al. ..... 84/645
6,417,439 B2 * 7/2002 Uehara et al. ..... 84/645
7,227,075 B2 * 6/2007 Chang et al. ..... 84/645
2002/0061772 A1 5/2002 Hayashi
2004/0123727 A1 * 7/2004 Hales ..... 84/645
2004/0139842 A1 * 7/2004 Brenner et al. ..... 84/477 R
2004/0257007 A1 * 12/2004 Lys et al. ..... 315/294
2007/0188427 A1 * 8/2007 Lys et al. ..... 345/82

FOREIGN PATENT DOCUMENTS

CN 1432981 A 7/2003
JP 3067197 12/1999
JP 2000-276141 A 10/2000
JP 2002-159066 A 5/2002
JP 2003-99056 A 4/2003

OTHER PUBLICATIONS

English Abstract for Japanese Patent Application No. 3067197 dated Dec. 22, 1999.
Office Action for Chinese Patent Application 2005100063937.4 issued Sep. 25, 2009 with English translation.
Japanese Office Action for Japanese Patent Application No. 2005-057608 dated Apr. 28, 2009 with English translation.

* cited by examiner

*Primary Examiner*—Jeffrey Donels
(74) *Attorney, Agent, or Firm*—Cantor Colburn LLP

(57) ABSTRACT

Electronic equipment includes a processing unit which controls light emission from LEDs by referring to music data described in a music file such as a MIDI file. The processing unit controls light emission from the LEDs by detecting the occurrence of sound described in the music file. Light emission from the LEDs may be controlled in accordance with tone data and/or a track number included in the music file. Alternatively, light emission from the LEDs may be controlled in accordance with volume data.

11 Claims, 8 Drawing Sheets

FIG.6A

| Bit7 | Bit6 | Bit5 | Bit4 | Bit3 | Bit2 | Bit1 | Bit0 |
|---|---|---|---|---|---|---|---|
| Delta Time | | | | | | | |
| Track Number 0~63 | | | | | | Voice Number | |
| Tone ON | Key[6:0] | | | | | | |
| Tone | | | | | | | |
| — | | L-Volume | | | | | |
| Mute | — | R-Volume | | | | | |

FIG.6B

| Bit7 | Bit6 | Bit5 | Bit4 | Bit3 | Bit2 | Bit1 | Bit0 |
|---|---|---|---|---|---|---|---|
| Delta Time | | | | | | | |
| Track Number 0~63 | | | | | | Voice Number | |
| Tone OFF | Key[6:0] | | | | | | |

FIG.7A

| | TONE No. | LIGHT EMISSION CONDITION |
|---|---|---|
| LED26a | 1 | TONE-ON |
| LED26b | 2 | TONE-ON |
| LED26c | 3 | TONE-ON |

FIG.7B

| | TRACK No. | LIGHT EMISSION CONDITION |
|---|---|---|
| LED26a | 1 | TONE-ON |
| LED26b | 2 | TONE-ON |
| LED26c | 3 | TONE-ON |

FIG.7C

| | TRACK No. | LIGHT EMISSION CONDITION |
|---|---|---|
| LED26a | 1, 2 | TONE-ON & $Vol > Vol_{th}$ |

ELECTRONIC EQUIPMENT SYNCHRONOUSLY CONTROLLING LIGHT EMISSION FROM LIGHT EMITTING DEVICES AND AUDIO CONTROL

BACKGROUND OF THE INVENTION

1. Field of the Invention

The present invention generally relates to electronic equipment provided with light emitting devices and, more particularly, to electronic equipment provided with the function of controlling light emission from the light emitting devices in synchronization with audio.

2. Description of the Related Art

One of the methods known to play back music in electronic equipment is to play back the waveform sampled from sound. Recently, technologies adapted for electronic equipment for synchronously playing back music and emitting light from light emitting devices have been developed. According to one related-art technology for controlling the intensity of light emitted from light emitting devices in accordance with audio data, there is proposed an infrared wireless microphone in which a carrier that is modulated in accordance with a sound signal input via a microphone controls the intensity of light emitted by infrared LEDs (see, for example, patent document No. 1).

[Patent Document No. 1]

Japanese Utility Model No. 3067197

One problem associated with delivering waveform data of music to electronic equipment over a wireless or wired network is that transmission may take a long period of time due to a large data size of sound waveform. According to another approach to deliver music data, music data that complies with a predetermined format such as that defined in the Musical Instruments Digital Interface (MIDI) standard is generated. The music data thus generated, which describes sound information, is transmitted. A MIDI file only hold information such as tone of sound, pitch, on/off of sound and sound volume, instead of waveform data. In comparison with waveform data, a MIDI file is of a small data size and is suitable for delivery. For example, it has become common for people to download a ringtone melody via a wireless network for their cell phones. By formatting music data as a MIDI file, the volume of data transmission is reduced. In recent years, electronic equipment such as cell phones come with a variety of functions that add values to the equipment. Often, it may be these additional functions that attract users. It is envisaged that, by putting music data described in a music file such as a MIDI file to uses other than playback of music, electronic equipment appealing to users will be produced.

SUMMARY OF THE INVENTION

The present invention has been done in view of the aforementioned circumstances and its object is to provide a technology for providing electronic equipment such as cell phones with the function of controlling light emission in synchronization with sound.

In order to achieve the aforementioned object, the present invention according to one aspect provides electronic equipment comprising a light emitting device and an audio output unit. The audio output unit outputs audio by referring to a music file describing music data. The electronic equipment includes a control unit which detects the occurrence of sound by analyzing the music file and controls light emission from the light emitting device. By using the music data to control light emission, playback of music and light emission from the light emitting device are synchronized.

The present invention according to another aspect provides electronic equipment comprising a light emitting device and an audio output unit. The audio output unit outputs audio by referring to a music file describing music data. The electronic equipment comprises a control unit which controls light emission from the light emitting device using a result of pre-processing the music file for audio output from the audio output unit. By using the result of analysis of the music file processed for audio output to control light emission, playback of music and light emission from the light emitting device are synchronized, without requiring data dedicated to light the light emitting device.

The present invention according to still another aspect provides electronic equipment comprising a light emitting device and an audio output unit. The electronic equipment according to this aspect comprises: a matrix array of a plurality of scan lines and a plurality of data lines; a matrix array of a plurality of light emitting devices provided at intersections of the plurality of scan lines and the plurality of data lines; a drive voltage supplying unit which supplies a drive voltage to the plurality of scan lines; a plurality of constant current circuits each of which is provided for a corresponding one of the plurality of data lines and which generates a constant current to feed through the light emitting device connected to the corresponding data line; a plurality of switch elements each of which is provided for a corresponding one of the plurality of constant current circuits and which subjects the current generated by the corresponding constant current circuit to pulse width modulation control; an audio output unit which outputs audio by referring to a music file describing music data; and a control unit which detects the occurrence of sound by analyzing the music file and controls on and off the plurality of switch elements by pulse width modulation. According to this aspect, playback of music and light emission from the light emitting devices in a matrix array are synchronized.

It is to be noted that any arbitrary combination or rearrangement of the above-described structural components and so forth are all effective as and encompassed by the present embodiments.

Moreover, this summary of the invention does not necessarily describe all necessary features so that the invention may also be sub-combination of these described features.

BRIEF DESCRIPTION OF THE DRAWINGS

FIG. 6A illustrates a note-on message format; and FIG. 6B illustrates a note-off message format.

FIG. 7A illustrates an example of table defining the condition of LED emission; FIG. 7B illustrates another example of table defining the condition of LED emission; and FIG. 7C illustrates still another example of table defining the condition of LED emission.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

Figure 1:
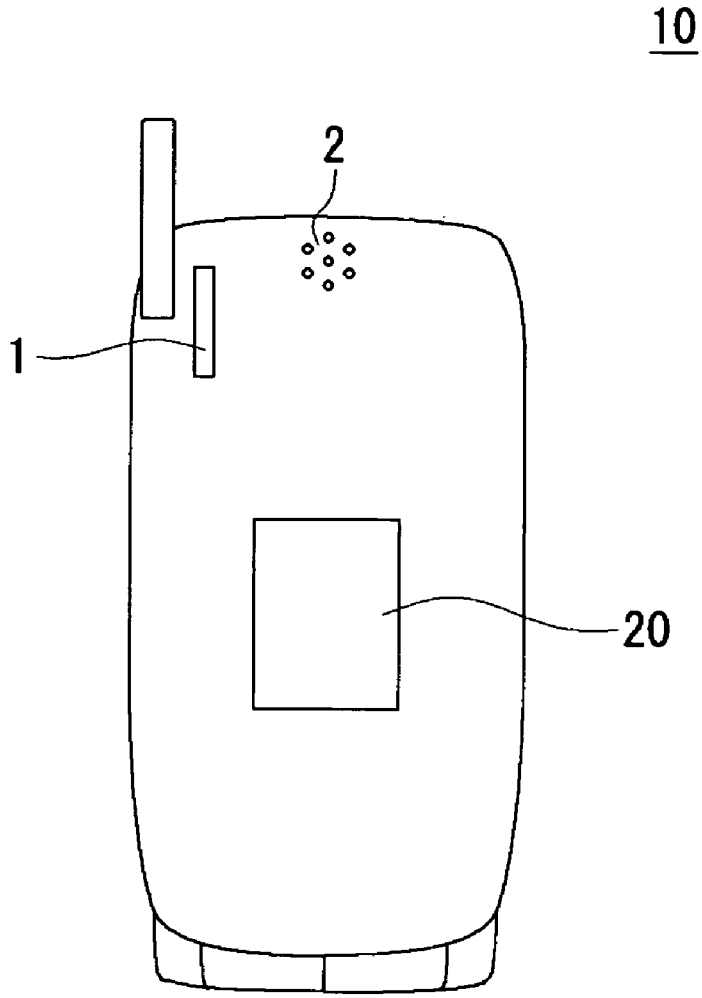
FIG. 1 illustrates the appearance of electronic equipment provided with the function of controlling light emission from the light emitting device according to the examples.

FIG. 1 illustrates the appearance of an electronic equipment unit 10 provided with the function of light emission control according to the examples of the present invention. The electronic equipment unit 10 comprises a communication function, an audio output function and a light emission control function. The electronic equipment unit 10 is, for example, a cell phone provided with an incoming call display unit 1, a speaker 2 and a liquid crystal display (hereinafter, referred to as LCD) 20. Though FIG. 1 illustrates a clamshell cell phone as an example of the electronic equipment unit 10, the invention is applicable to other types. The electronic equipment unit 10 maybe a portable terminal such as a personal digital assistant (PDA) and a portable game device instead of a cell phone. Alternatively, the electronic equipment unit 10 may be an alarm clock, a radio or an audio unit. The electronic equipment 10 need not be of a portable type as long as it is provided with the functions for audio output and light emission control.

The incoming call unit 1 is provided with light-emitting devices such as light-emitting diodes (hereinafter, referred to as LEDs). The incoming call unit 1 is provided with LEDs of three colors including red (R), green (G) and blue (B). When an incoming call is detected, the incoming call unit 1 lights the LEDs in a predetermined format and notifies the user of the incoming call by the light emission. These LEDs emit light in synchronization with a ringtone output from the speaker 2. By lighting the LEDs independently, a variety of colors are produced.

The LCD 20 is provided with LEDs as backlight and displays, for example, clock time while a call is not proceeding. The LCD 20 may display in a similar way to the incoming call display unit 1 when there is an incoming call. That is, the LCD 20 may controls emitted light in synchronization with the ringtone output from the speaker 2.

Figure 2:
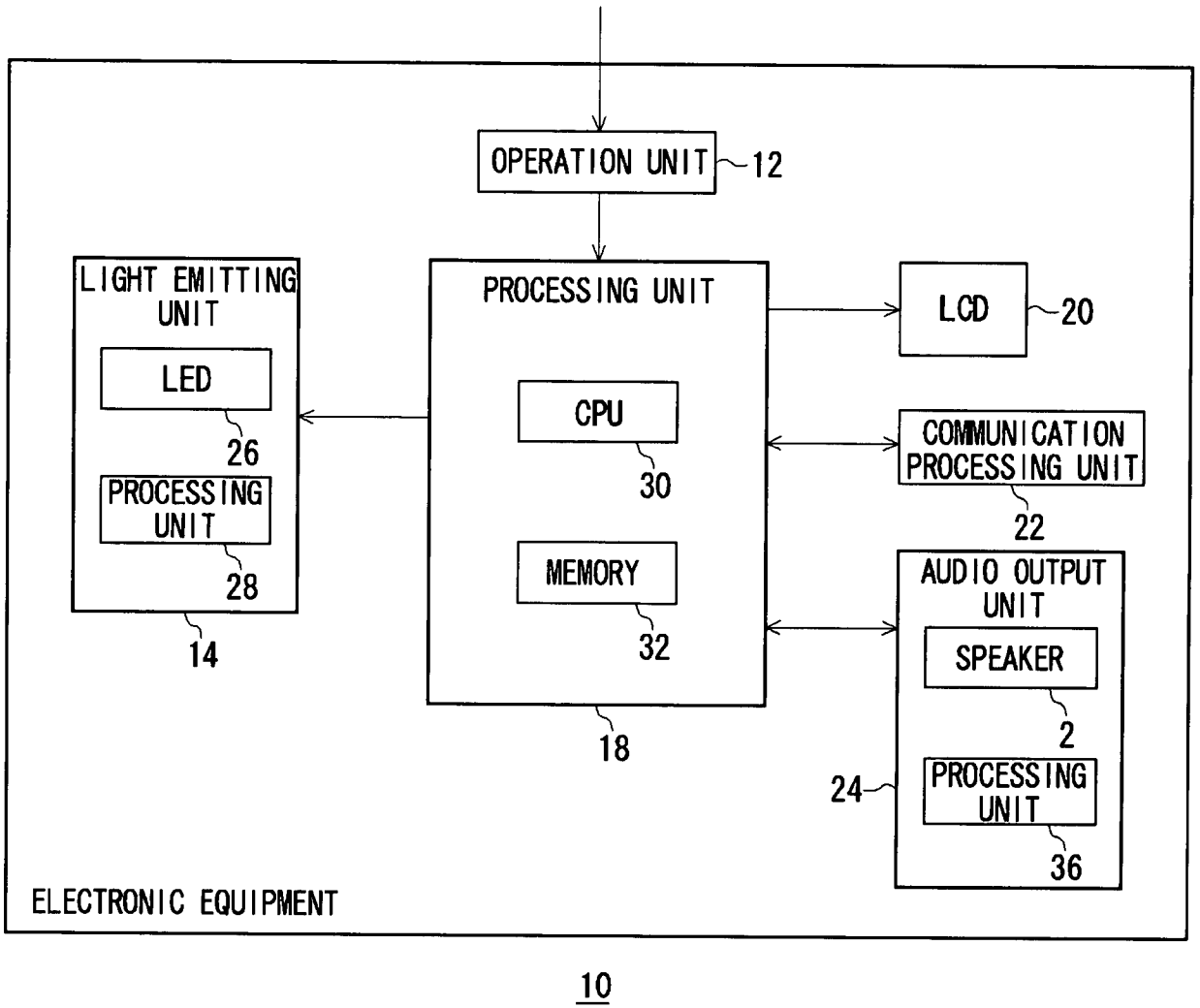
FIG. 2 is a block diagram illustrating the electronic equipment.

FIG. 2 illustrates functional blocks of the electronic equipment unit 10 according to the examples. The electronic equipment unit 10 includes an operation unit 12, a light emitting unit 14, a processing unit 18, an LCD 20, a communication processing unit 22 and an audio output unit 24. The light emitting unit 14 includes LEDs 26 and a processing unit 28. The processing unit 28 includes a CPU 30 and a memory 32. The audio output unit 24 includes a speaker 2 and a processing unit 36. The operation unit 12 includes buttons for user input of telephone numbers etc. The light emitting unit 14 includes LED 26 of red, green and blue and is built in the incoming call unit 1 of FIG. 1. The light emitting unit 14 may be built as backlight for the LCD 20. The CPU 30 performs overall control of the electronic equipment unit 10. The CPU 30 in the processing unit 18, the processing unit 28 in the light emitting unit 14 and the processing unit 36 in the audio output unit 24 together function as a control unit for synchronously controlling light emission from the LEDs 26 and audio output from the speaker 2.

The communication processing unit 22 is a communication unit for executing processes necessary for communication. More specifically, the communication processing unit 22 detects an incoming call from another phone or a server, or originates a call to another phone or a server. The phrase "incoming call" refers not only to an incoming call from a phone but also to the arrival of a packet from a server via a network. The same applies to the origination of a call. The cell phone may employ the personal digital cellular system (PDC) or a mobile communication system such as the simplified cell phone system, the code division multiple access (CDMA) system and the GSM system.

The communication processing unit 22 downloads a ringtone melody from a server via a network. For reduction of data transmission volume, the communication processing unit 22 downloads a music file describing music data. A MIDI file is a typical example of music file describing music data. The music file may be a GM file, currently the de facto industry standard. Music files described in compliance with other standards may also be processed. Whatever is the format, the advantage of a music file is that the transmission volume is small as compared to waveform data of music downloaded. The downloaded music file is stored in the memory 32. The following description assumes that ringtone data is written in compliance with the MIDI standard.

When the communication processing unit 22 detects an incoming call, the audio output unit 24 plays back a predetermined ringtone for alerting the use of an incoming call. The processing unit 36 of the audio output unit 24 runs a program so as to play back the ringtone stored as data in the memory 32. The processing unit 36 may be configured as an IC dedicated to audio output. The processing unit 36 is configured as a MIDI sound source having the function of a sequencer for organizing the order MIDI data and the MIDI processing function for analyzing the MIDI file. The processing unit 36 outputs music from the speaker 2 in accordance with the result of analysis of the MIDI file. Occurrence ("on") of sound is detected by identifying "tone on" included in a note-on message in MIDI data. Non-occurrence ("off") of sound is detected by identifying "tone off" included in a note-off message. In the described examples, it will be assumed that not only music data downloaded from a server but also music data preloaded in the electronic equipment 10 is formatted as a MIDI file. With this, the capacity of the memory 32 is used efficiently. The speaker 2 provides an audible output of the ringtone played in the processing unit 36.

The light emitting unit 14 lights the LEDs 26 in synchronization with the ringtone when an incoming call is detected in the communication processing unit 22. The processing unit 28 acquires the result of analysis of the MIDI file in the processing unit 36 of the audio output unit 24 and executes a process for lighting the LEDs 26 in accordance with the result of analysis. More specifically, the processing unit 28 controls light emission from the LEDs 26 in accordance with the occurrence and non-occurrence of sound detected as a result of analysis of the music file.

The processing unit 18 performs overall control of the processes in the electronic equipment 10 and includes a central processing unit (CPU) 30 and a memory 32. The memory 32 may be an externally coupled memory. The CPU 30 has the function of controlling audio output by the audio output unit 24 and LED light emission by the light emitting unit 14, in cooperation with the processing unit 36 and the processing unit 38, when an incoming call arrives. The CPU 30, notified of an incoming call by the communication processing unit 22, transfers a music file stored in the memory 32 to the audio output unit 24 and forwards the result of analysis of the music file in the processing unit 36 to the processing unit 28 of the light emitting unit 14. With this, the processing unit 28 is capable of detecting the occurrence of sound and controlling light emission from the LEDs 26 in synchronization with the music sound output from the speaker 2. In the described examples, the need for creating extra data for control of light emission from the LEDs is eliminated by directly using the result of analysis of the MIDI file for control of light emission from the LEDs 26. Accordingly, the processing load imposed by light emission control is small. Further, since the LEDs 26 in three colors are made to respond to the sound, the light emission timing is controlled to adapt to the music, providing audiovisual entertainment to users.

Figure 3:
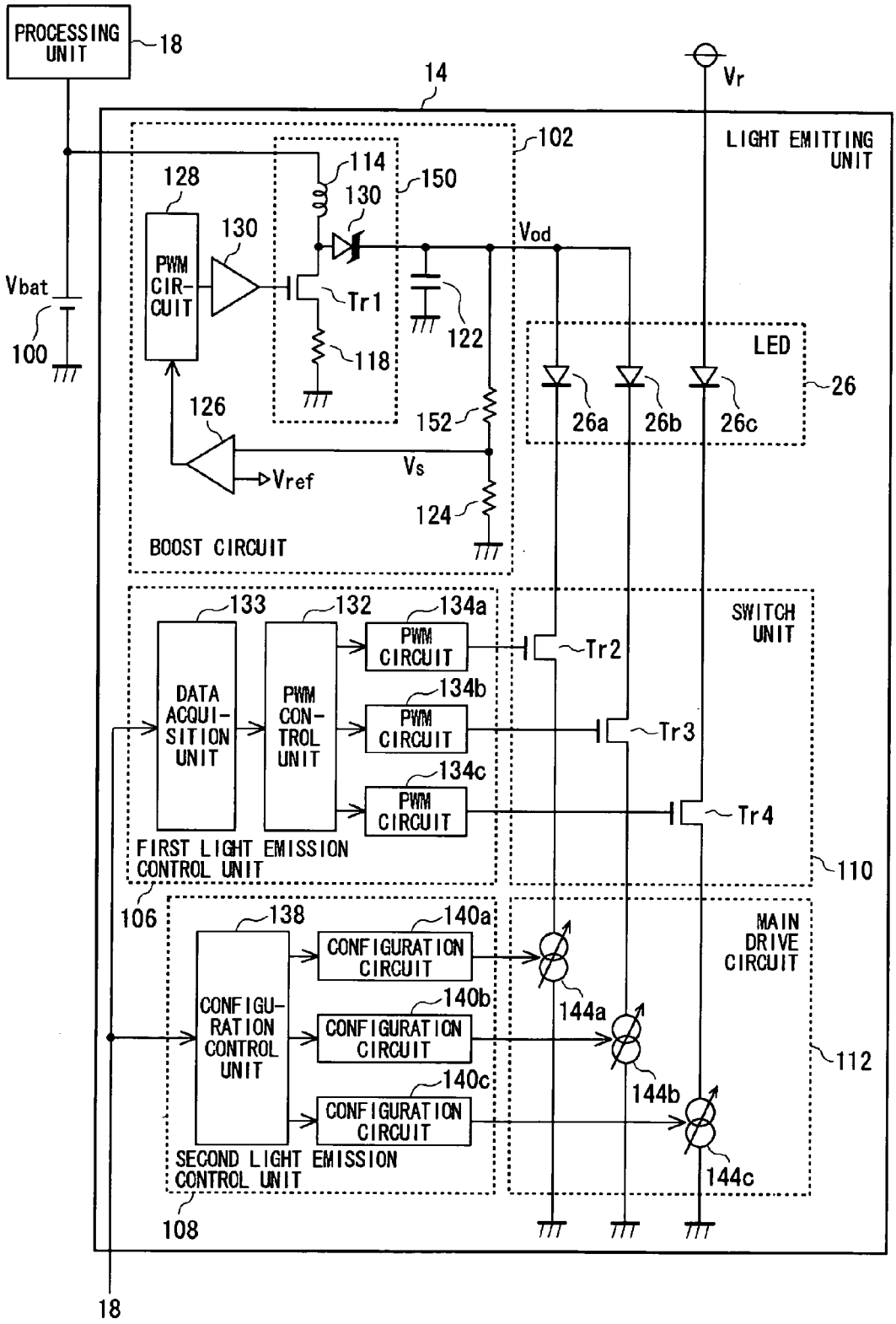
FIG. 3 illustrates the structure of a light emitting unit.

FIG. 3 illustrates the structure of the light emitting unit 14. The light emitting unit 14 is connected to a lithium ion battery 100 and the processing unit 18 and includes: a boost circuit 102; a first LED 26*a*, a second LED 26*b* and a third LED 26*c*, generically referred to as LEDs 26; a first light emission control unit 106; a second light emission control unit 108; a switch unit 110, and a main driving circuit 112. The boost circuit 102 includes a boost chopper circuit 150, a capacitor 122, a first resistor 152, a second resistor 124, an error amplifier 126, a pulse width modulation (PWM) circuit 128 and a driver 130. The boost chopper circuit 150 includes an inductance 114, a resistor 118, a driver 130 and a transistor Tr1. The first light emission control unit 106 includes: a PWM control unit 132; a first PWM circuit 134*a*, a second PWM circuit 134*b*, a third PWM circuit 134*c*, generically referred to as PWM circuits 134; and a data acquisition unit 133. The second light emission control unit 108 includes: a configuration control unit 138; and a first configuration circuit 140*a*, a second configuration circuit 140*b* and a third configuration circuit 140*c*, generically referred to as configuration circuits 140. The switch unit 110 includes a transistor Tr2, a transistor Tr3 and a transistor Tr4. The main driving circuit 112 includes a first variable current circuit 144*a*, a second variable current circuit 144*b* and a third variable current circuit 144*c*, generically referred to as variable current circuits 144. Those parts of the light emission unit 14 other than the LEDs 26 correspond to the processing unit 28 of FIG. 2.

The boost circuit 102 receives the battery voltage Vbat of the lithium ion battery 100 at its input and outputs a boosted voltage Vod by boosting the input voltage in a switching configuration. It will be assumed here that the battery voltage is 3V. The boost chopper circuit 150 charges the inductance 114 with energy and discharges the energy from the inductance 114 according to the on/off operation of the transistor Tr1. This way, the boost chopper circuit 150 boosts the battery voltage Vbat, converting it into a boosted voltage Vod. While the transistor Tr1 in the boost chopper circuit 150 is being on, a drain current flows into the resistor 118 via the inductance 114. The battery voltage Vbat causes the inductance 114 to store magnetic energy. When the transistor Tr1 is turned off, the magnetic energy stored in the inductance 114 while the transistor Tr1 is being on is discharged as electric energy and turns into a current that flows in the driver 130. The voltage generated by the inductance 114 is superimposed on the battery voltage Vbat in series, and output as the boosted voltage Vod.

The step-up ratio applied to the boosted voltage Vod output from the boost chopper circuit 150 is determined by the on/off time ratio of the transistor Tr1 operating as a switch. The PWM circuit 128 is responsible for the production of the on/off time ratio of the switch. Given that the period of on/off switching is T and the duration of an "on" period of the switch is Ton, the PWM circuit 128 generates a pulse signal with a duty ratio of Ton/T. The driver 130 subjects the transistor Tr1 to on/off control in accordance with the pulse signal generated by the PWM circuit 128. That is, when the pulse signal is high, the transistor Tr1 is turned on. When the pulse signal is low, the transistor Tr1 is turned off.

The pulse width of the pulse signal generated by the PWM circuit 128 varies with the output of the error amplifier 126. The error amplifier 126 compares a reference voltage Vref from a reference voltage source with an indicator voltage Vs obtained by diving the boosted voltage Vod by the first voltage divider resistor 152 and the second voltage divider resistor 124. The error amplifier 126 amplifies an error between the reference voltage and the indicator voltage Vs and feeds back the amplified error to the PWM circuit 128. The PWM circuit 128 modulates the pulse width of the pulse signal by controlling the on duration Ton of the switch, in accordance with an output from the error amplifier 126. The PWM circuit 128 thus matches the indicator voltage Vs with the reference voltage Vref by feedback control.

The first LED 26*a* emits green light, the second LED 26*b* emits blue light and the third LED 26*c* emits red light. Since the first LED 26*a* and the second LED 26*b* generally operate with a drive voltage of about 4.5V, the boosted voltage Vod is set to 4.5V. In contrast, the third LED 26*c* generally operates with a drive voltage of about 2.5V and so Vr is set to 2.5V. The main drive circuit 112 described later feeds currents of a maximum of 25 mA to drive the LEDs 26.

The transistors Tr2 through Tr4 are provided between the LEDs 26 and the main drive circuit 112 described later, so as to operate as switches for electrically connecting or disconnecting the LEDs 26 and the main drive circuit 112. More specifically, when a voltage applied to the gate of the transistor Tr2 goes high, turning the transistor Tr2 on, the first LED 26*a* and the first variable current circuit 144*a* are electrically connected. The transistor Tr3 and the transistor Tr4 operate similarly. While any of the transistors Tr2 through Tr4 is being turned on, the corresponding one of the LEDs 26 is lighted. The transistors Tr2 through Tr4 are independently turned on by the first light emission control unit 106 described later.

The variable current circuit 144 is a constant current circuit capable of varying the value of current generated. The variable current circuit 144 feeds a current for driving each of the LEDs 26. The magnitude of current fed by the variable current circuit 144 is controlled by the second light emission control unit 108 described later to have one of a plurality of discrete values, the maximum value thereof being about 25 mA, as described before. The luminance of the LEDs 26 is varied according to the current with one of the plurality of discrete values. While the first variable current circuit 144*a* through the third variable current circuit 144*c* may feed currents of mutually different values, it will be assumed here that the circuits feed currents of the same value.

The data acquisition unit 133 receives the result of analysis of the music file in the audio output unit 24 via the processing unit 18. The result of analysis corresponds to the result of pre-processing the music file for audio output performed in the audio output unit 24. More specifically, the result includes sound information including on and off of sound, tone, track number used and sound volume. In the described examples, the result of analysis of a MIDI file describing music data is acquired for control light emission from the LEDs 26. The pre-processing of the music file is a process of analysis necessary for audio output from the audio output unit 24. According to the described examples, the need for creating extra data for control of light emission is eliminated by using the result of pre-processing. With this, the processing load imposed by light emission control is reduced. It will also be noted that, what is used in the described examples for light emission control is not the result of audio output. Therefore, perfect timing synchronization between audio output and light emission is achieved. By using the music file data efficiently as described, audio output and light emission are produced in an effective way. A specific method of using the music data will be described later.

The PWM control unit 132 controls the LEDs 26 to emit respective color tones in accordance with the result of analysis of the music data acquired by the data acquisition unit 133 from the audio output unit 24. The PWM control unit 132 may operate in response to the supply of the result of analysis of the music data to the data acquisition unit 133. Alternatively, the PWM control unit 132 may operate in response to the notification of an incoming call to the processing unit 18. The PWM control unit 132 generates light emission data for lighting the LEDs 26 by referring to the result of analysis of the music data. The light emission data is for determining whether each of the LEDs 26 should be lighted. More specifically, the data determines whether each of the transistors Tr2 through Tr4 should be turned on or off.

The light emission data could be data for turning the transistors Tr2 through Tr4 on and off with a predetermined duty ratio to light the LEDs 26 but also could be transistor-dependent data for turning the transistors Tr2 through Tr4 on for different durations so that the quantity of light emitted by the LEDs 26 differ from LED to LED, in order to realize a desired color tone.

The PWM circuit 134 executes PWM in accordance with a direction from the PWM control unit 132. For example, when the first PWM circuit 134*a* is directed by the PWM control circuit 132 to increase the quantity of light emission from the LED 26*a*, the PWM circuit 134 may generate a pulse signal with extended high period and output the same to the transistor Tr2. The second PWM circuit 134*b* and the third PWM circuit 134*d* operate similarly.

The configuration control unit 138 controls the magnitude of the drive current fed by the variable current circuit 144. In order to increase the luminance of the LEDs 26, the configuration control circuit 138 controls the operation of the configuration circuit 140 so as to increase the drive current fed by the variable current circuit 144. As mentioned before, the drive currents fed by the first variable current circuit 144*a* through the third variable current circuit 144*c* are identical. Therefore, the configuration control unit 138 performs the same control on the first configuration circuit 140*a* through the third configuration circuit 140*c*.

Figure 4A:
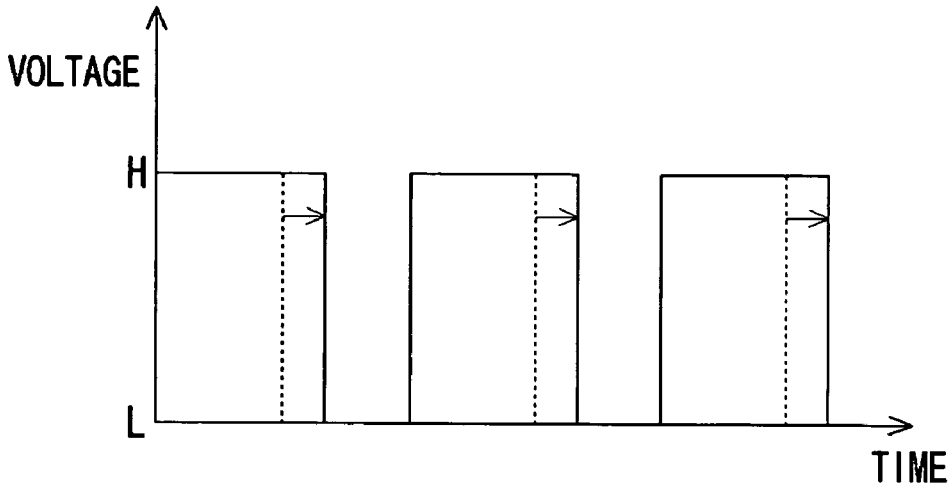
FIG. 4A illustrates the operation of a first light emission control unit.

FIG. 4A illustrates the operation of the first light emission control unit 106, highlighting a PWM pulse signal generated by the first light emission control unit 106. As illustrated, the first light emission control unit 106 generates a pulse signal with alternate high levels and low levels. Each of the transistors Tr2 through Tr4 described before is turned on when a voltage at a high level is applied, causing a corresponding one of the LEDs 26 to be lighted. In order to increase the quantity of light emission from a desired one of the LEDs 26, the first light emission control unit 106 extends the duration of high-level period so as to turn a pulse signal as indicated by a broken line into a signal as indicated by a solid line. By regulating the duty ratio of the plurality of LEDs 26, the color tone is varied in an analog fashion.

Figure 4B:
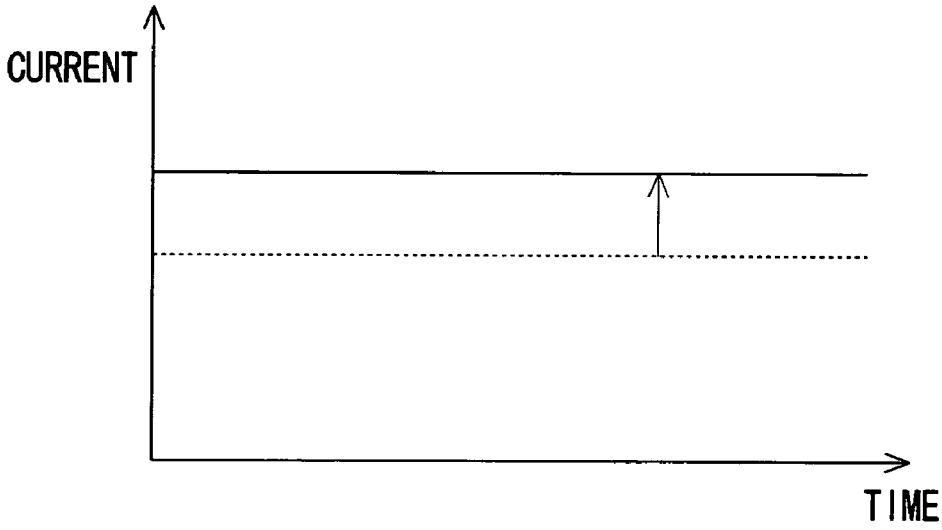
FIG. 4B illustrates the operation of a second light emission control unit.

FIG. 4B illustrates the operation of the second light emission control unit 108, highlighting the magnitude of the drive current fed by the variable current circuit 144. By controlling the magnitude of the drive current from a level indicated by a broken line to a level indicated by a solid line, the luminance of a corresponding one of the LEDs 26 is increased.

As illustrated in FIG. 4A, the PWM control circuit unit 132 is capable of regulating the quantity of light emission from the LEDs 26 by regulating the duty ratio of the PWM signal. Further, as illustrated in FIG. 4B, the configuration control unit 138 is capable of regulating the quantity of light emission from the LEDs 26 by regulating the magnitude of the drive current. By regulating the quantity of light emission as described, the LEDs 26 are controlled in an analog fashion to emit light with desired luminance. Accordingly, fine luminance regulation on the LEDs 26 emitting light in synchronization with the music is achieved.

Figure 5:
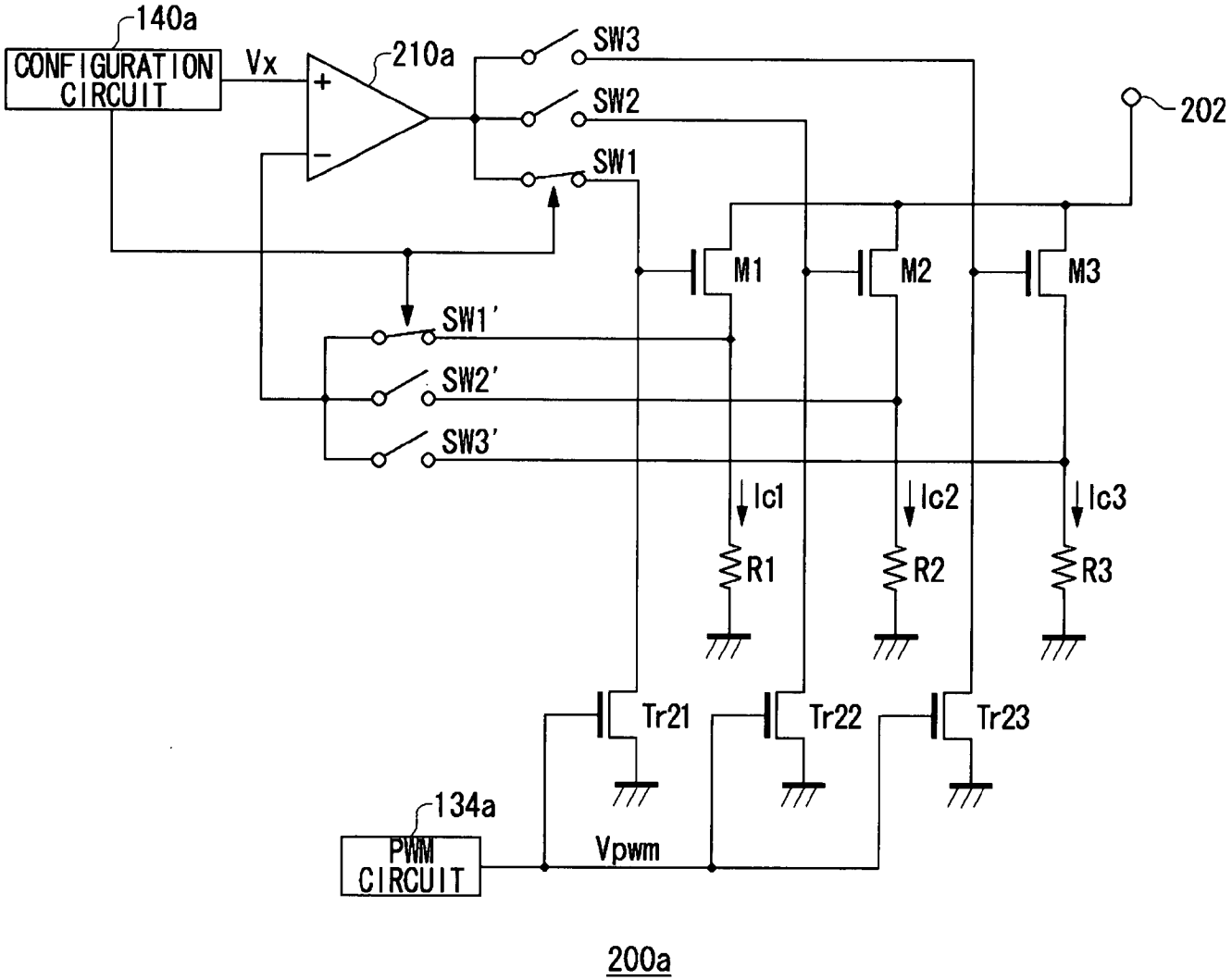
FIG. 5 is a circuit diagram illustrating the structure of a constant current driver circuit.

Luminance regulation of the LEDs 26 may be performed by a constant current driver circuit 200 described below. FIG. 5 is a circuit diagram of a constant current driver circuit 200*a* for driving the LED 26*a*, provided as an integrated unit comprising the transistor Tr2, the first variable current circuit 144*a*, the first configuration circuit 140*a* and the first PWM circuit 134*a* of FIG. 3. The constant current driver circuit 200 is provided for each of the LEDs 26. The constant current driver circuits 200*b* and 200*c* similarly configured are provided for the LED 26*b* and the LED 26*c*, respectively.

The constant current driver circuit 200*a* includes an operational amplifier 210*a*, switches SW1-SW3, switches SW1'-SW3', transistors M1-M3, transistors Tr21-Tr23, resistors R1-R3, the first PWM circuit 134*a* and the first configuration circuit 140*a*. The cathode terminal of the LED 26*a* of FIG. 3 is connected to a current output terminal 202.

The structure and operation of the constant current driver circuit 200*a* will be described by taking an example where the switch SW1 and the switch SW1' are turned on.

When the switches SW1 and SW1' are turned on, a feedback loop is formed by the operational amplifier 210*a*, the transistor M1 and the resistor R1. Given that the current that flows in the transistor M1 is Ic1, a voltage drop of R1×Ic1 occurs across the resistor R1. The voltage drop across the resistor R1 is fed back to the inverting input of the operational amplifier 210*a* via the switch SW1'. To the non-inverting input of the operational amplifier 210*a* is fed a reference voltage Vx output from the first configuration circuit 140*a*.

An output voltage from the operational amplifier 210*a* is fed to the gate terminal of the transistor M1. The operational amplifier 210*a* controls the gate voltage so that the voltage input to the non-inverting input and the voltage input to the inverting input are identical. A feedback is applied in the constant current driver circuit 200*a* so that a relation R1×Ic=Vx holds. This results in a constant current given by Ic1=Vx/R1 being fed to the LED 26*a* connected to the current output terminal 202.

The transistor Tr21 has its drain terminal and source terminal connected to the gate terminal of the transistor M1 and the ground, respectively. The gate terminal of the transistor Tr21 is connected to the first PWM circuit 134*a*.

When the first PWM circuit 134*a* generates a pulse-width modulated control signal Vpwm, the transistors Tr21 is alternately turned on and off in accordance with the duty ratio of the control signal Vpwm while the switches SW1 and SW1' are being turned on. Thus, the transistors Tr21-Tr23 operate as switching elements corresponding to the transistor Tr2 in FIG. 3.

While the transistor Tr21 is being turned on, the gate voltage of the transistor M1 is forced to a low level so that the current Ic1 is 0. While the transistor Tr21 is being turned off, the current given by Ic1=Vx/R1 is generated since due to the feedback control on the gate voltage of the transistor M1.

According to the constant current driver circuit 200*a* configured as described above, the value of current Ic1 is controlled by the reference voltage Vx output from the first configuration circuit 140*a*. The period of time in which the current Ic1 is generated is controlled by the duty ratio of the control signal Vpwm. Thus, the constant current driver circuit 200*a* is capable of controlling a period of time of light emission from the LED 26*a* connected to the current output terminal 202 and regulating the luminance of the LED26*a* with precision.

Similarly, a current Ic2=Vx/R2 is generated while the switches SW2 and SW2' are turned on. A current Ic3=Vx/R3 is generated while the switches SW3 and SW3' are turned on.

For example, the resistance of the resistors R1-R3 and the size of the transistors M1-M3 may be configured such that the driver circuit operates properly when Ic=1-3 mA while the switches SW1 and SW1' are turned on, Ic=4-10 mA while the switches SW2 and SW2' are turned on, and Ic=11-30 mA while the switches SW3 and SW3' are turned on.

The current Ic is regulated by configuring the on and off states of the switches SW1-SW3 and the switches SW1'-SW3' by the first configuration circuit 140*a*. With this, the luminance of light emitted by the LED 26*a* connected to the current output terminal 202 is changed.

A description will be given of the operation of the light emitting unit 14 with the structure described above. When the processing unit 18 issues a direction for light emission when an incoming call arrives, Vbat output from the lithium ion battery 100 is boosted to Vod and applied to the first LED 26*a* and the second LED 26*b*. Vr, which is lower than Vbat, is applied to the third LED 26*c*. The PWM control unit 132 determines the quantity of light commensurate with the color tone to be produced by light emitted from the LEDs 26, in accordance with the contents of music data acquired in the data acquisition unit 133. The PWM control unit 132 designates to the PWM circuit 134 the duty ratio commensurate with the quantity thus determined. The PWM circuit 134 generates a pulse signal by PWM so as to turn on the transistors Tr2 through Tr4 in a high-level period of the pulse signal. The second light emission control unit 108 determines the quantity of light commensurate with the luminance to be produced by light emitted from the LEDs 26. The configuration circuit 140 regulates the magnitude of current fed by the variable current circuits 144 in accordance with the determined quantity. The LEDs 26 are driven by the currents thus regulated.

A description will be given of the data format of a MIDI file as an example of music file describing music data.

FIG. 6A illustrates the format of a note-on message. Items included in the format will be described.

"Delta Time" denotes a time that elapses since an event immediately preceding music data.

"Track Number" denotes a track ID used. Numerals 0, 1, 2 and 3 are assigned in the order of occurrence of tracks.

"Voice Number" denotes a voice ID in a track. Numerals 1, 2 and 3 are assigned in the order of occurrence of voices in the track.

"Tone ON" denotes that sound is on, i.e., that sound occurs. The value "1" is assigned to Tone ON. Therefore, when the Tone ON bit is 1, it indicates that there is sound to be output. In the described examples, the audio output is produced and the LED 26 is subject to light emission control when a Tone ON bit is identified.

"Key[6:0]" denotes the music scale of sound produced.

"Tone" denotes the tone of a sound source. For example, the tone of piano is assigned to tone No. 1, and the tone of guitar is assigned to tone No. 2. Assignment is determined by a MIDI sound source used.

"L-Volume" denotes the volume of left channel.

"R-Volume" denotes the volume of right channel.

FIG. 6B illustrates the format of a note-off message. "Tone ON" denotes that sound is off, i.e., that sound does not occur. The value "0" is assigned to Tone OFF. In the described examples, audio output is suspended when a Tone-OFF bit is identified. The light emission control on the LED 26 corresponding to the music data including the Tone-OFF bit is also suspended. When light emission control is applied on a given color LED 26 in accordance with a plurality of music data items, the LED 26 may be maintained lighted even when sound from one of the music data items is off, as long as sound from any of the other music data items on. Under this light emission control, the LEDs 26 is extinguished when sound from the entirety of music data corresponding to the LEDs 26 is off.

Responsive to the note-on message, the processing unit 36 in the audio output unit 24 detects "on" of sound by identifying a Tone-ON bit. The processing unit 36 then causes a scale of notes commensurate with the designated tone, volume and key to be played from a track specified in a data format.

The processing unit 28 of the light emitting unit 14 receives the result of process in the processing unit 36 of the audio output unit 24 via the processing unit 18. The processing unit 28 then executes light emission control. A description will now be given of specific examples of the method of controlling light emission in the processing unit 28.

SPECIFIC EXAMPLE 1

The processing unit 28 controls light emission from the LEDs 26 in accordance with tone data included in a music file. Light emission from the LEDs 26 of the respective colors may be controlled by referring to tone data included in the note-on message illustrated in FIG. 6A. For example, the tone data may be categorized into three groups. The tricolor LEDs 26 may be respectively assigned to the three categories. When the tone of a piano is assigned to tone No. 1, the tone of a guitar is assigned to tone No. 2, and the tone of a trumpet is assigned to tone No. 3, the greed LED 26*a* may be assigned to tone No. 1, the blue LED 26*b* may be assigned to tone No. 2, and the red LED 26*c* may be assigned to tone No. 3.

FIG. 7A illustrates an example of table defining the condition of LED emission. The table is retained in, for example, the PWM control unit 132. According to this table, the LEDs 26 are lighted on the condition that the tone numbers match and a Tone-ON bit is identified. When tone No. 1 is designated in a note-on message, the PWM control unit 132 responds to this by subjecting the green LED 26*a* corresponding to tone No. 1 to light emission control. In case the audio output unit 24 permits the playback of a 16-chord, there will be a maximum of 16 tracks. The PWM control unit 132 refers to a note-on message for each of these tracks to subject the LED 26 corresponding to the specified tone number to light emission control. With this, light emission control coordinated with the tone of music is enabled. Users can enjoy light emission from the LEDs 26 coordinated with the tone of music. In the specific example 1, it is assumed that a given color LED 26 is assigned to a single tone number. Alternatively, a plurality of LEDs 26 may be assigned to a single tone number. Further, FIG. 7A only shows three tone numbers for brevity of explanation. Actually, it is preferable that the LEDs 26 be assigned to all of the tone numbers defined in the MIDI standard.

SPECIFIC EXAMPLE 2

The processing unit 28 controls light emission from the LEDs 26 in accordance with a track number included in a music file. For example, light emission from the LEDs 26 of the respective colors maybe controlled by referring to the track number included in the note-on message illustrated in FIG. 6A. For example, the track numbers may be categorized into three groups. The tricolor LEDs 26 may be respectively assigned to the three categories.

FIG. 7B illustrates another example of table defining the condition of LED emission. According to this table, the LEDs 26 are lighted on the condition that the track numbers match and a Tone-ON bit is identified. When sound is "on" in a track identified by a track number, which is assigned to one of the LED colors, the PWM control unit 132 subjects the LED 26 corresponding to the "sound-on" track number to light emission control. In case the audio output unit 24 permits the playback of a 16-chord, there will be a maximum of 16 tracks. The PWM control unit 132 refers to a note-on message for each of these tracks to subject the LED 26 corresponding to the specified track number to light emission control. While FIG. 7B only shows only three track numbers 1 through 3, sixteen track numbers are each assigned to one of the LEDs 26 when 16-chord playback is permitted. Since the track number corresponds to the tone of music, this will result in light emission control coordinated with the tone of music. A given tone may correspond to different track numbers in different musical tunes. In such a case, users can enjoy how different colors are emitted in synchronization with the same tone, depending on the tunes. While a given color LED 26 is assigned to a single track number in the specific example 2, a plurality of LEDs 26 may be assigned to a single track number.

SPECIFIC EXAMPLE 3

The processing unit 28 controls light emission from the LEDs 26 in accordance with volume data included in a music file. For example, light emission from the LEDs 26 of the respective colors may be controlled by referring to the volume data included in the note-on message illustrated in FIG. 6A. For example, a volume threshold value Volth may be preset. When the value of volume data Vol exceeds the threshold value Volth, the PWM control unit 132 subjects the corresponding LED 26 to light emission control. In this case, the color of the LED 26 to be lighted may be mapped into the tone number or the track number, as described in the specific example 1 and the specific example 2. When the tone number or the track number is mapped into the LED 26 to be lighted, the PWM control unit 132 subjects the corresponding LED 26 to light emission control when the volume Vol of the tone or the track, in which sound is on, exceeds the threshold value Volth.

FIG. 7C illustrates still another example of table defining the condition of LED emission. According to this table, the LED 26*a* is lighted on the condition that the track numbers match, the volume value Vol>Volume threshold Volth and a Tone-ON bit is identified. In the illustrated example, the LED 26*a* is lighted when a Tone-ON bit is identified AND the condition related to volume is met, for one of the track number 1 and the track number 2. Light emission may be associated with the tone numbers instead of the track numbers. With this, users can enjoy light emission from the LEDs 26 coordinated with the volume of music played.

If there are a plurality of tone numbers or track numbers corresponding to a given color in the specific examples 1 through 3 described above, the PWM control unit 132 may light the corresponding LED 26 with constant luminance. Alternatively, the quantity of light emitted by the corresponding LED 26 may be regulated in an analog fashion. More specifically, the luminance of a given color LED 26 may be regulated in accordance with the number of "sound-on" tones or track numbers associated with the LED 26. By regulating the luminance as described above, it is possible to present a variety of color changes and so allow users to enjoy coordinated sound and light.

According to the examples of the present invention, audio and light emission are synchronized by using a music file, such as a MIDI file, that describes music data in controlling light emission from light emitting devices. By directly using data of music file to control light emission, it is not necessary to create extra data for light emission. Synchronization of light emission and playback of music is achieved relatively easily.

Described above is an explanation based on the examples. The examples of the present invention are only illustrative in nature and it will be obvious to those skilled in the art that various variations in constituting elements and processes are possible within the scope of the present invention.

In the described examples, the tricolor LEDs 26*a*-26*c* are driven. Alternatively, LEDs in a matrix array may be driven.

Figure 8:
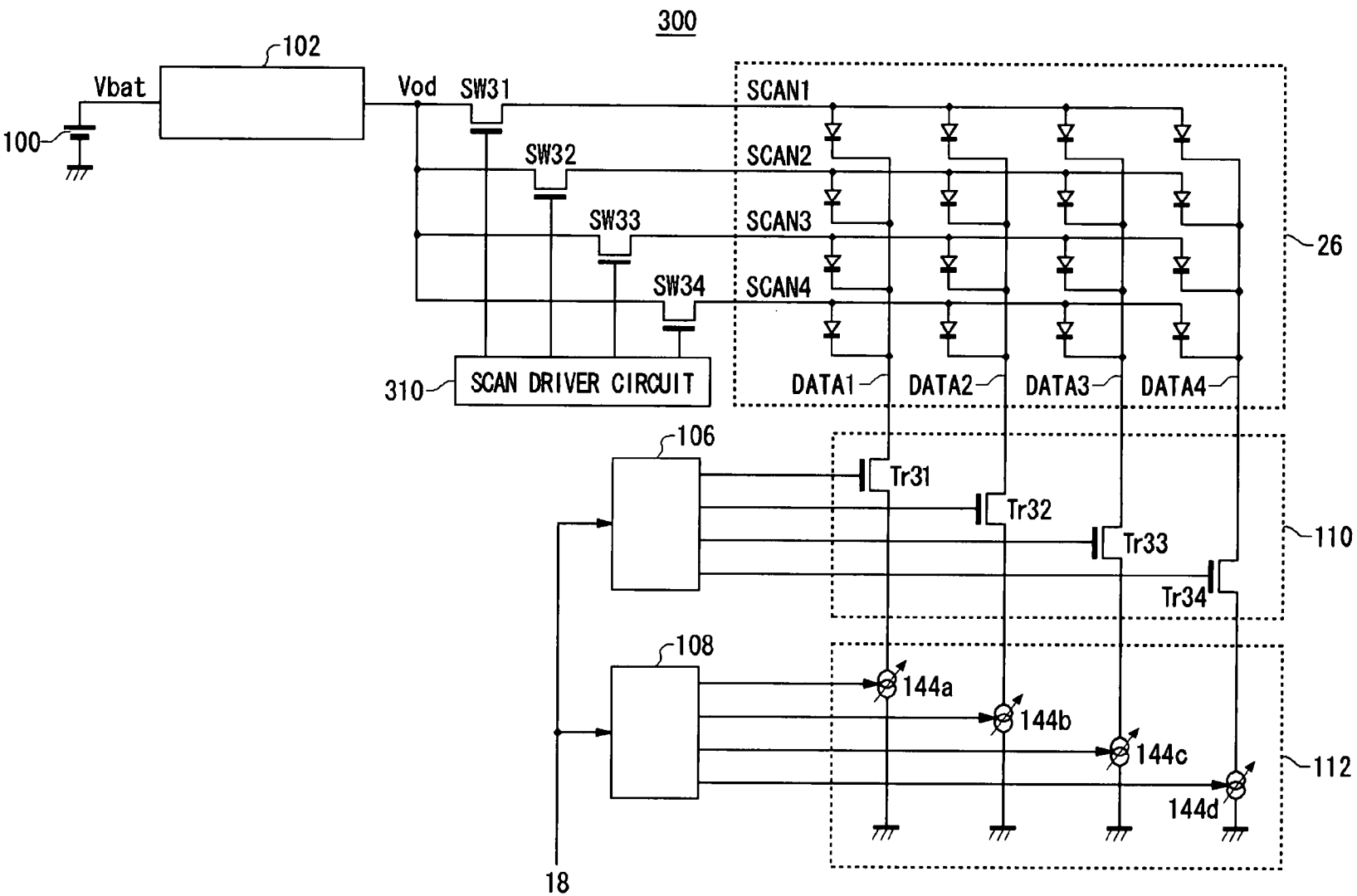
FIG. 8 illustrates the structure of a light emitting unit that includes light emitting diodes in a matrix array.

FIG. 8 illustrates the structure of the light emitting unit 30 that includes the LEDs 26 in a matrix array. The LEDs 26 may emit the same color or different colors. Referring to FIG. 8, those constituting elements that are similar to or identical with the corresponding elements in FIG. 3 are identified by the same symbols and the description thereof is omitted. The light emitting unit 300 includes a boost circuit 102, LEDs 26, a switch unit 110, a main drive circuit 112, a first light emission control unit 106, a second light emission unit 108, a scan drive circuit 310 and scan line switches SW31-SW34.

For example, the LEDs 26 may be provided as a 4×4 matrix array comprising a plurality of LEDs. Four scan lines SCAN1-SCAN4, generically referred to as scan lines SCAN, are provided in each row. Four data lines DATA1-DATA4, generically referred to as data lines DATA, are provided in each column. Each LED is provided at an intersection of the data line DATA and the scan line SCAN. The anode terminal of the LED is connected to the scan line SCAN and the cathode terminal is connected to the data line DATA.

The boost circuit 102, the scan driver circuit 310 and the switches SW31-SW34 function as a drive voltage supplying unit for sequentially supplying a drive voltage to the scan lines SCAN1-SCAN4. The scan lines SCAN1-SCAN4 are connected to an output terminal of the boost circuit 102 via the switches SW31-SW34, respectively. The scan driver circuit 310 sequentially turns on the switches SW31-SW34 on a time-shared basis. The boosted voltage Vod output from the boost circuit 102 is applied to those of the scan line SCAN1-SCAN4 connected to the corresponding ones of the switches SW31-SW34 that are turned on.

When the switch SW31 is turned on, the LED 26 connected to the scan line SCAN1 can be lighted. By allowing the first light emission control unit 106 and the second light emission control unit 108 to respectively control the transistors Tr31-Tr34 and the variable current circuits 144, in a similar way to the light emitting unit 14 of FIG. 3, a constant current Ic commensurate with music data is fed through the data lines DATA1-DATA4. As a result, the LED 26 connected to the scan line SCAN1 is lighted in synchronization with the volume, etc. of music played.

When the switch SW31 is turned off and the switch SW32 is turned on, the LED 26 connected to the scan line SCAN2 is lighted in synchronization with the volume, etc. of music played.

By sequentially turning the switches SW31-SW34 on, all of the LEDs 26 in a matrix array are lighted.

According to the light emitting unit 300 of FIG. 8, the LEDs in a matrix array are subject to light emission control in synchronization with music. Therefore, users can derive more amusement from sound and light coordinated.

In the light emitting unit 300 of FIG. 8, the constant current may be fed to the data lines DATA1-DATA4 using the constant current driver circuit 200 illustrated in FIG. 5.

What is claimed is:

1. Electronic equipment comprising:

a communication processing unit operative to detect an incoming call from outside;

a memory operative to store a music file describing music data;

a CPU operative to request playback of the music file stored in the memory in response to a signal, indicating the detection of an incoming call, from the communication processing unit;

an audio output unit provided with a speaker and a processing unit, the speaker being operative to output sound based on the music file when an instruction for playback is received from the CPU and the processing unit being operative to analyze the music file when an instruction for playback is received from the CPU; and a light-emitting unit provided with a light-emitting device and a light-emission processing unit operative to control light emission from the light-emitting device in accordance with the result of analysis of the music file by the processing unit, wherein the light-emitting unit comprises:

a constant-current circuit connected to the light-emitting device in series and operative to drive the light-emitting device with a current set by an instruction from the CPU;

a switch element operative to receive an instruction from the CPU and turn the current generated by the constant-current circuit on and off; and a pulse width modulation circuit operative to modulate a signal for controlling on and off of the switch element by using pulse width modulation in response to an instruction from the CPU.

2. The electronic equipment according to claim 1, wherein the light-emission processing unit controls light emission from the light emitting device in accordance with tone data included in the music file.

3. The electronic equipment according to claim 1, wherein the light-emission processing unit controls light emission from the light emitting device in accordance with a track number included in the music file.

4. The electronic equipment according to claim 1, wherein the light-emission processing unit controls light emission from the light emitting device in accordance with volume data included in the music file.

5. The electronic equipment according to claim 1, wherein the constant current circuit comprises:

a transistor;

a resistor which has its one end grounded and the other end connected to the transistor; and an operational amplifier which has its output terminal connected to a control terminal of the transistor, its non-inverting input fed a reference voltage and its inverting input fed a feedback input of a voltage occurring at the other end of the resistor.

6. The electronic equipment according to claim 5, wherein the switch element is provided between the control terminal of the transistor and a ground potential.

7. The electronic equipment according to claim 1, further comprising a boost circuit which supplies a drive voltage to the light emitting device.

8. The electronic equipment according to claim 1, wherein the light emitting device is a light emitting diode.

9. The electronic equipment according to claim 1, wherein the music file is described according to the MIDI standard.

10. Electronic equipment comprising:

a communication processing unit operative to detect an incoming call from outside;

a memory operative to store a music file describing music data;

a CPU operative to request playback of the music file stored in the memory in response to a signal, indicating the detection of an incoming call, from the communication processing unit;

an audio output unit provided with a speaker and a processing unit, the speaker being operative to output sound based on the music file when an instruction for playback is received from the CPU and the processing unit being operative to analyze the music file when an instruction for playback is received from the CPU; and a matrix array of a plurality of scan lines and a plurality of data lines;

a matrix array of a plurality of light emitting devices provided at intersections of the plurality of scan lines and the plurality of data lines;

a drive voltage supplying unit which supplies a drive voltage to the plurality of scan lines sequentially;

a plurality of constant current circuits each of which is provided for a corresponding one of the plurality of data lines and which generates a constant current to feed through the light emitting device connected to the corresponding data line in response to an instruction from the CPU;

a plurality of switch elements each of which is provided for a corresponding one of the plurality of constant current circuits and which turns the current generated by the corresponding constant current circuit to on and off in response to an instruction from the CPU;

a plurality of pulse width modulation circuits each of which is provided for a corresponding one of the plurality of switch elements and which modulates a signal for controlling on and off time of the corresponding switch element by using pulse width modulation in response to an instruction from the CPU.

11. Electronic equipment comprising:

a communication processing unit operative to detect an incoming call from outside;

a memory operative to store a music file describing music data;

a CPU operative to request playback of the music file stored in the memory in response to a signal, indicating the detection of the incoming call, from the communication processing unit;

an audio output unit provided with a speaker and a processing unit, the speaker being operative to output sound based on the music file when an instruction for playback is received from the CPU and the processing unit being operative to analyze the music file when the instruction for playback is received from the CPU; and a light-emitting unit provided with a light-emitting device and a light-emission processing unit operative to control light emission from the light-emitting device in accordance with a result of analysis of the music file by the processing unit, wherein the light-emitting unit comprises:

a current output terminal connected to the light-emitting device;

a first transistor and a resistor connected in series between the current output terminal and a ground terminal;

an operational amplifier operative to receive a reference voltage at its non-inverting input and receive, at its inverting input, a potential at a node connected to the first transistor and the resistor via a first switch;

a second switch provided between an output terminal of the operational amplifier and the gate of the first transistor;

a second transistor provided between a gate of the first transistor and the ground terminal;

a pulse width modulation circuit operative to output a pulse-width modulated control signal to the gate of the second transistor; and a configuration circuit operative to output the reference voltage and turn the first and second switches on to generate a current being fed to the light-emitting device when the instruction for playback is received.

* * * * *